US009776773B1

(12) United States Patent
Chen

(10) Patent No.: US 9,776,773 B1
(45) Date of Patent: Oct. 3, 2017

(54) FASTENER CONTAINER

(71) Applicant: CHENG YU ENTERPRISES CO., LTD., Tainan (TW)

(72) Inventor: Min-Chien Chen, Tainan (TW)

(73) Assignee: CHENG YU ENTERPRISES CO., LTD., Tainan (TW)

( * ) Notice: Subject to any disclaimer, the term of this patent is extended or adjusted under 35 U.S.C. 154(b) by 0 days.

(21) Appl. No.: 15/365,741

(22) Filed: Nov. 30, 2016

(51) Int. Cl.

| | |
|---|---|
| ***B65D 85/24*** | (2006.01) |
| ***B65D 43/16*** | (2006.01) |
| ***B65D 25/10*** | (2006.01) |
| ***B65D 43/22*** | (2006.01) |
| ***B65D 51/26*** | (2006.01) |
| ***B25H 3/02*** | (2006.01) |

(52) U.S. Cl.
CPC ..... *B65D 43/169* (2013.01); *B25H 3/02* (2013.01); *B65D 25/10* (2013.01); *B65D 43/22* (2013.01); *B65D 51/26* (2013.01)

(58) Field of Classification Search
CPC .... B25D 43/169; B25D 25/10; B25D 25/101; B25D 51/26; B25D 43/22; B25H 3/02
USPC ..... 206/338, 349, 372, 373, 1.5, 379, 376, 206/377, 470, 467, 461
See application file for complete search history.

(56) References Cited

U.S. PATENT DOCUMENTS 3,394,835 A * 7/1968 Peterson ..... E05D 7/1077 220/833
3,695,481 A * 10/1972 Foster ..... B65D 43/169 220/324
4,928,823 A * 5/1990 Campbell ..... A45C 13/02 206/338
5,417,339 A * 5/1995 Liu ..... B65D 43/169 206/338
6,971,517 B2 * 12/2005 Chen ..... B25H 3/02 190/122
7,165,695 B2 1/2007 Choi
8,434,617 B1 * 5/2013 Wang ..... B25H 3/02 206/372
9,403,270 B2 * 8/2016 Lin ..... B25H 3/02
2008/0099546 A1 * 5/2008 Cronin ..... B65D 43/169 229/125.26
2010/0308055 A1 * 12/2010 Sams ..... A61M 5/3205 220/324
2012/0111750 A1 * 5/2012 Phillips ..... B65D 25/22 206/338
2013/0284773 A1 * 10/2013 Meng ..... B25H 3/003 224/196
2014/0183075 A1 * 7/2014 Horiyama ..... B25H 3/02 206/349

(Continued)

*Primary Examiner* — Jacob K Ackun
*Assistant Examiner* — Jenine Pagan
(74) *Attorney, Agent, or Firm* — J.C. Patents

(57) ABSTRACT

The fastener container in the present invention includes a receptacle base and a lid as main components combined together. Said receptacle base and lid are connected by a hinge. So that, the container utilizes the integrally formed receptacle base and lid, the user does not need to worry about that the lid missing during use, and the container can be made in any size and the structure of the container does not affect the use of the user. Moreover, the special structure of receptacle base and lid of this invention can effectively solve the problem that the screws or items fall from the opening on the side of the container to the outside when the locked container be extruded deformation by external force.

6 Claims, 7 Drawing Sheets

(56) References Cited

U.S. PATENT DOCUMENTS

| | | | | |
|---|---|---|---|---|
| 2015/0034515 | A1* | 2/2015 | Monyak | E21F 17/18<br>206/349 |
| 2015/0352711 | A1* | 12/2015 | Brunner | B25H 3/02<br>206/349 |
| 2016/0346915 | A1* | 12/2016 | Lin | B25H 3/02 |

* cited by examiner

FASTENER CONTAINER

BACKGROUND OF THE INVENTION

1. Field of the Invention

This invention relates to a fastener container, particularly to a container having a lid and a receptacle base which are connected integral by a hinge to facilitate the user to take or store the fasteners and tools from the container.

2. Description of the Prior Art

The prior art such as U.S. Pat. No. 7,165,695 "Dispensing container for dispensing fasteners" which is consisted of a receptacle base 11 and a lid 23, the lid 23 has a front section 24 and a rear section 25 which are connected by a hinge 26. So that the rear section 25 of the lid 23 can be engaged with the foregoing receptacle base 11, and the foregoing hinge 26 allows the front section 24 of the lid 23 to be repeatedly opened and closed on the container.

However, the lid 23 and the receptacle base 11 of the foregoing container must be separately manufactured, and then the lid 23 and the receptacle base 11 are assembled into one body, so that the manufacturing cost is relatively higher than the integrally molded container. Moreover, only the front section 24 of the foregoing container can be opened and allows the user to take or place screws or other items therein, so the foregoing container is not suitable for use as a small-sized fastener container.

In addition, the foregoing container has only a receptacle base 11 for receiving various items, so if all the items are placed in the receptacle base 11, some commonly used tools will not be easy to take, resulting in the use of inconvenient.

For this reason, the inventor of this invention, having much experience in designing and manufacturing container and its related products, understands and researches the problem of the foregoing prior art and hence devised this invention.

SUMMARY OF THE INVENTION

The objective of this invention is to offer a new fastener container, wherein the container utilizes the integrally formed receptacle base and lid, so the user does not need to worry about that the lid missing during use, and the container can be made in any size and the structure of the container does not affect the use of the user. Moreover, the special structure of receptacle base and lid of this invention can effectively solve the problem that the screws or items fall from the opening on the side of the container to the outside when the locked container be extruded deformation by external force.

The fastener container in the present invention includes a receptacle base and a lid as main components combined together. Said receptacle base has a first space, the receptacle base is provided with an annular side wall, two upwardly extending combining circumference are separately set on the top of the annular side wall; the front end of the receptacle base has a foldable pendant which is provided with a through hole, and a protrusion is set on the outside of the front of the receptacle base for engagement with the through hole of the pendant; the top of said protrusion is provided with a first locking member.

The fastener container of present invention, among which said lid is connected with said receptacle base by a hinge, the lid has a second space, and the periphery of the lid is provided with a circumferential wall to correspond to the shape of said annular side wall of the receptacle base; a outwardly projecting outer baffle and a first inner baffle are individually provided under the both side of the circumferential wall, and a groove is formed between the outer baffle and the first inner baffle; the height of the first inner baffle is greater than the height of the outer baffle. A plurality of spaced second inner baffle is set on the inside of the front of said circumferential wall which is corresponding to the shape of said annular side wall of the receptacle base; the front of the lid is provided with a second locking member to cooperate with the first locking member of the receptacle base. The bottom of the second space of the lid is provided at least one tool holder(s).

The fastener container of present invention, among which a plurality of reinforcing ribs are arranged at the bottom of the receptacle base.

The fastener container of present invention, among which said tool holder can be the V-shape holder or U-shape holder.

BRIEF DESCRIPTION OF DRAWINGS

This invention will be better understood by referring to the accompanying drawings, wherein.

DETAILED DESCRIPTION OF THE PREFERRED EMBODIMENT

A preferred embodiment of a fastener container in the present invention, as shown in FIG. 1~13, includes a receptacle base 1 and a lid 2 as main components combined together. The receptacle base 1 and the lid 2 can be made of plastic, rubber or other elastic material, and the receptacle base 1 and the lid 2 are connected by a hinge 3.

Figure 1:
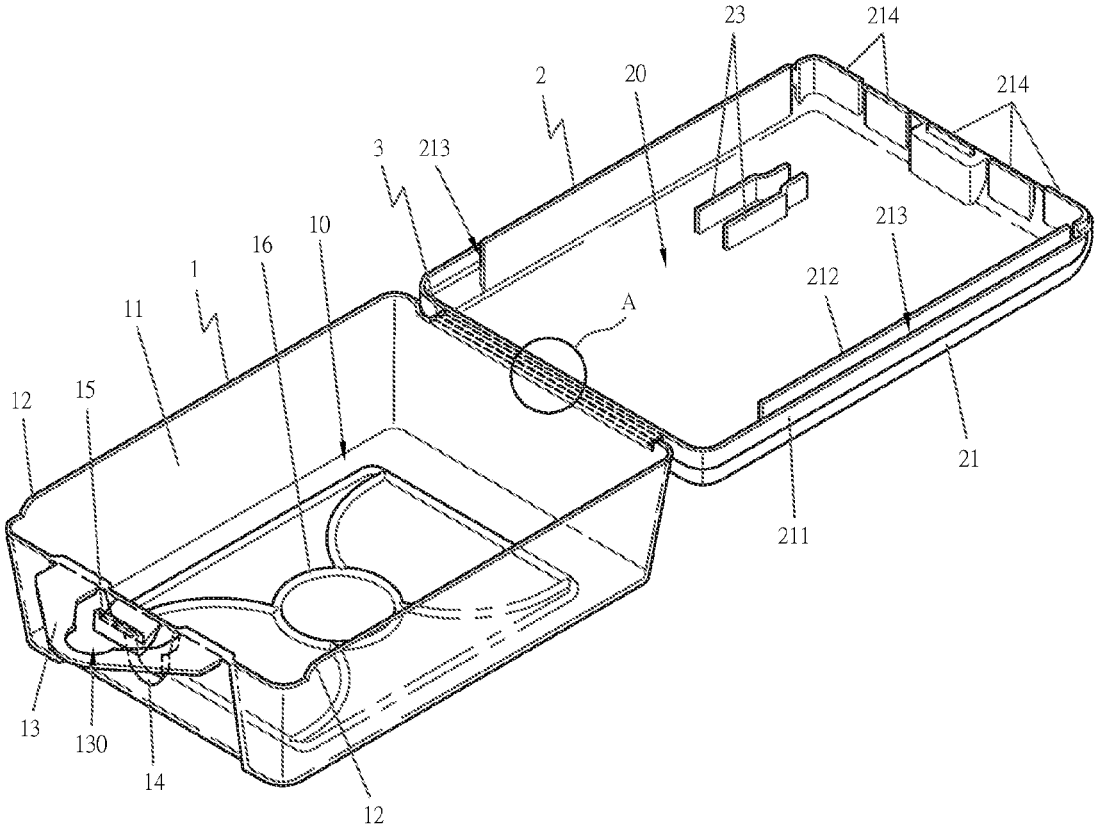
FIG. 1 is a three-dimensional view of the fastener container in the present invention.
Figure 2:
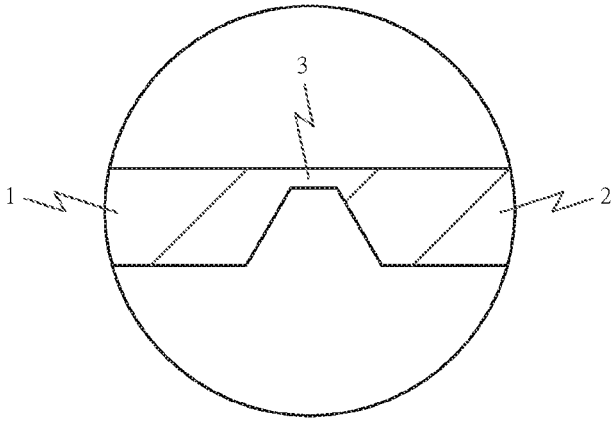
FIG. 2 is an enlarged view of area A shown in FIG. 1.
Figure 3:
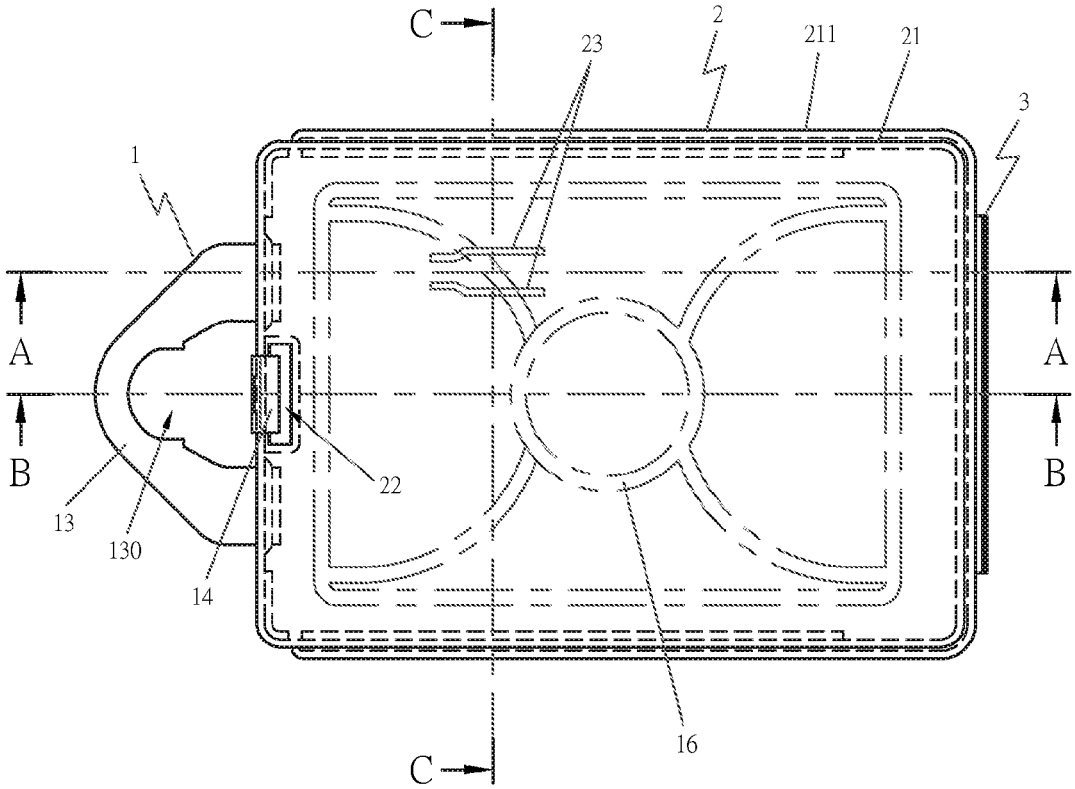
FIG. 3 a top view of the fastener container in the present invention.
Figure 4:
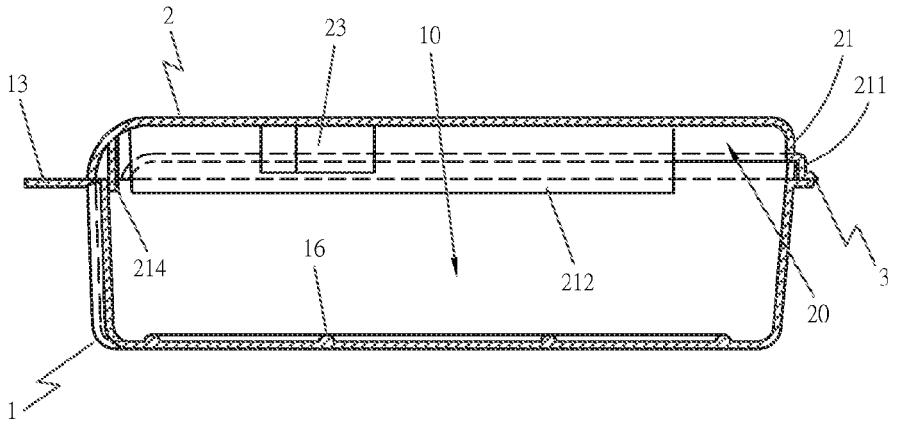
FIG. 4 is an enlarged sectional view of A-A shown in FIG. 3.
Figure 5:
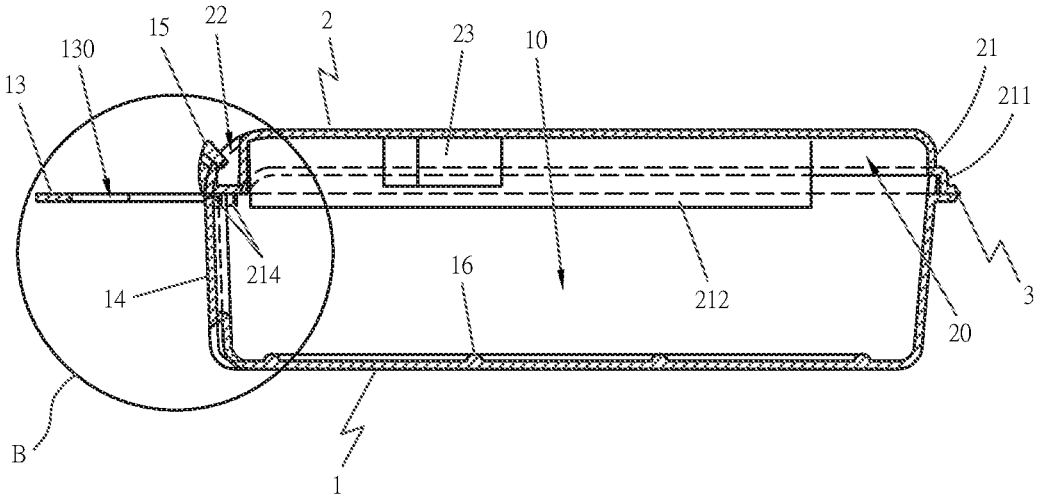
FIG. 5 is an enlarged sectional view of B-B shown in FIG. 3.
Figure 6:
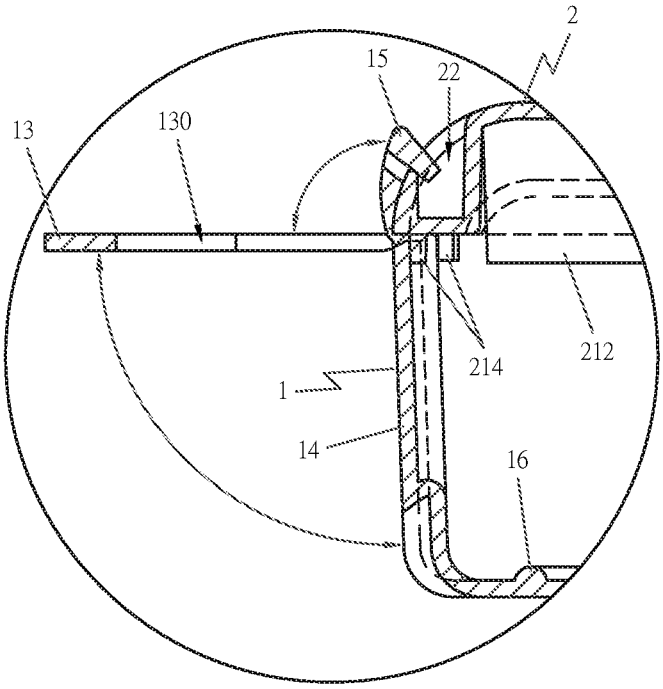
FIG. 6 is an enlarged view of area B shown in FIG. 5.
Figure 7:
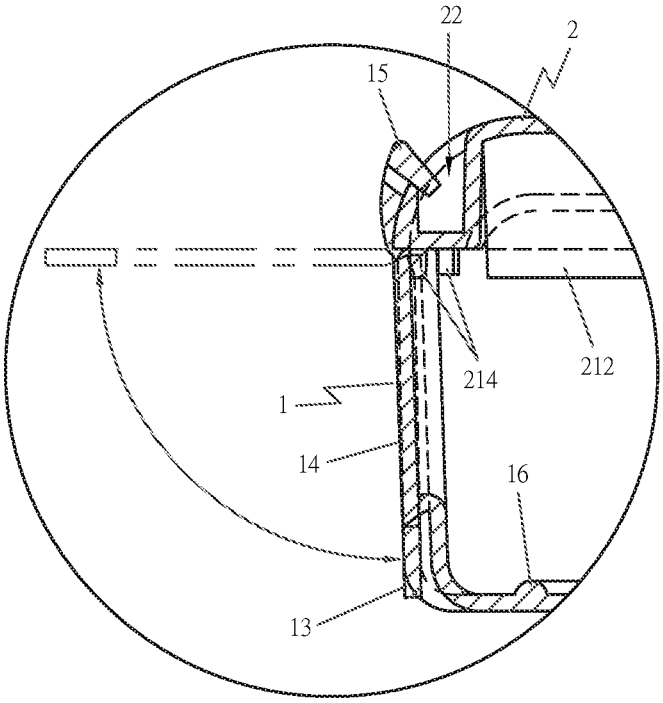
FIG. 7 is a first side view of the first and second locking member in the present invention.
Figure 8:
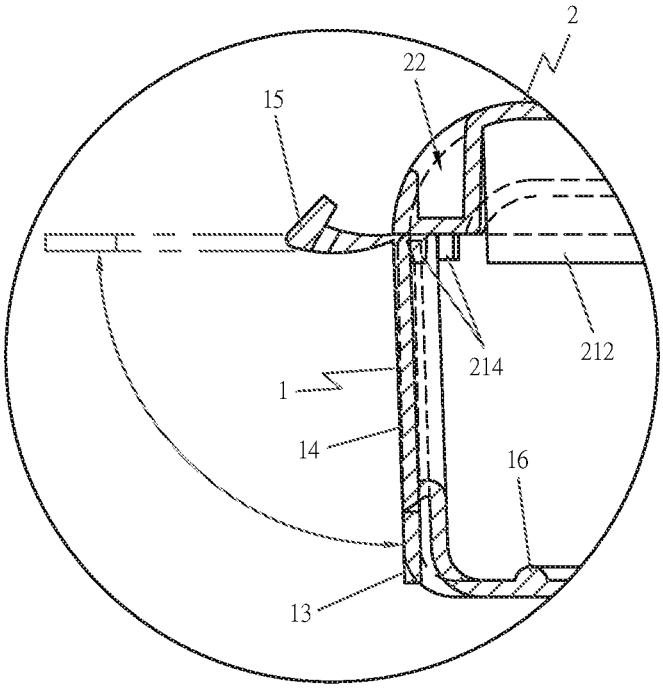
FIG. 8 is a second side view of the first and second locking member in the present invention.

Said receptacle base 1 has a first space 10 to contain screws or items, the receptacle base 1 is provided with an annular side wall 11 and two upwardly extending combining circumference 12 are separately set on the top of the annular side wall 11. The front end of the receptacle base 1 has a foldable pendant 13 which is provided with a through hole 130, and a protrusion 14 is set on the outside of the front of the receptacle base 1 to strengthen the structural strength of the receptacle base 1 and for engagement with the through hole 130 of the pendant 13, so that the pendant 13 can be hidden when not in use (as shown in FIGS. 6, 7 and 8). The top of said protrusion 14 is provided with a first locking member 15, and a plurality of reinforcing ribs 16 are arranged at the bottom of the receptacle base 1 (as shown in FIGS. 1 and 3).

Figure 9:
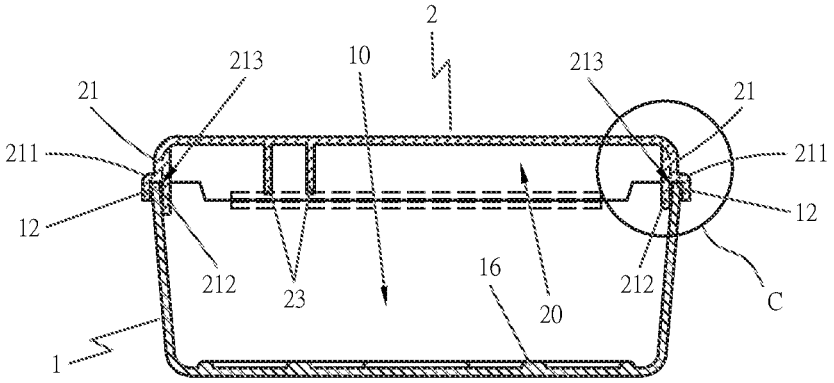
FIG. 9 is an enlarged sectional view of C-C shown in FIG. 3.
Figure 10:
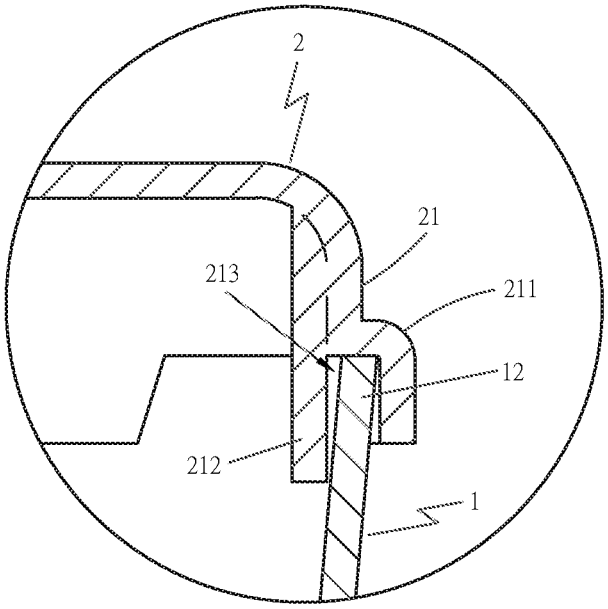
FIG. 10 is an enlarged view of area C shown in FIG. 9.

Said lid 2 has a second space 20, and the periphery of the lid 2 is provided with a circumferential wall 21 to correspond to the shape of said annular side wall 11 of the receptacle base 1. A outwardly projecting outer baffle 211 and a first inner baffle 212 are individually provided under the both side of the circumferential wall 21, and a groove 213 is formed between the outer baffle 211 and the first inner baffle 212 for containing the combining circumference 12 of the receptacle base 1 (as shown in FIGS. 9 and 10). The height of the first inner baffle 212 is greater than the height of the outer baffle 211, so that, by using the altitude difference between the outer baffle 211 and the first inner baffle 212, the combining circumference 12 of the receptacle base 1 will be more easily engaged with the groove 213 of lid 2, and the higher first inner baffle 212 can prevent the screws or items fall from the opening on the side of the container to the outside when the locked container be extruded deformation by external force.

A plurality of spaced second inner baffle 214 is set on the inside of the front of said circumferential wall 21 which is corresponding to the shape of said annular side wall 11 of the receptacle base 1 to prevent the screws or items fall from the opening on the front of the container to the outside when the locked container be extruded deformation by external force. The front of the lid 2 is provided with a second locking member 22 to cooperate with the first locking member 15 of the receptacle base 1 to lock and fix the receptacle base 1 and the lid 2 together.

Figure 11:
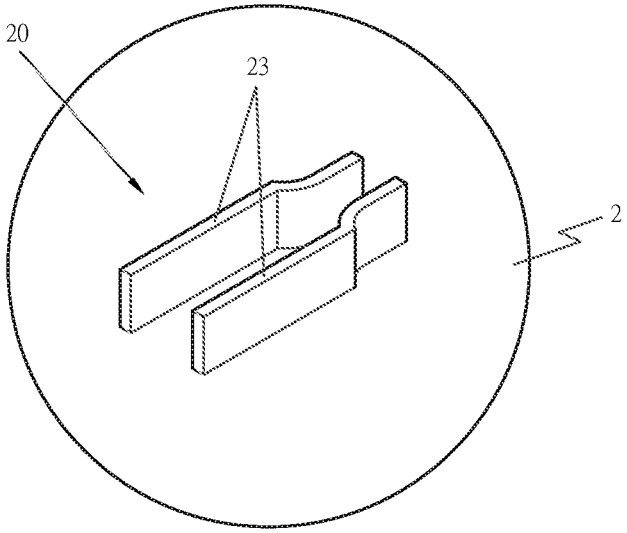
FIG. 11 is an enlarged view of the V-shape tool holder in the present invention.
Figure 12:
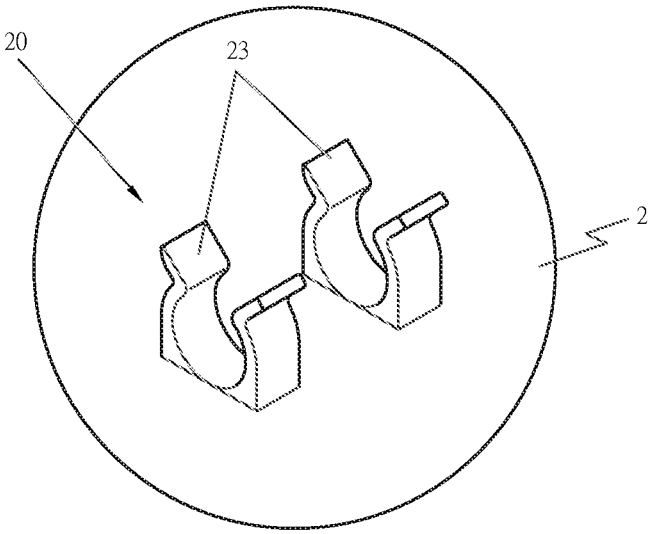
FIG. 12 is an enlarged view of the U-shape tool holder in the present invention.
Figure 13:
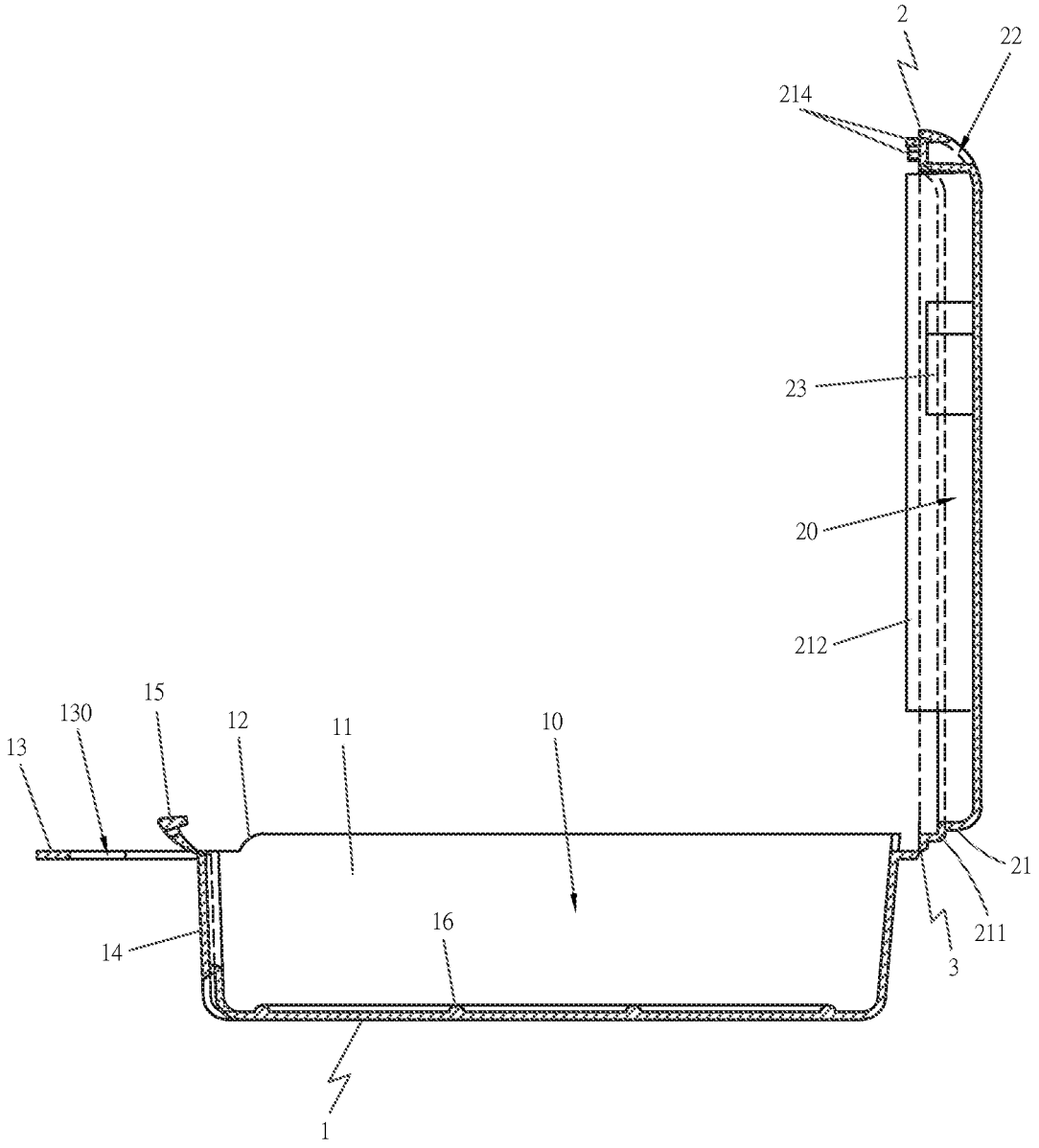
FIG. 13 is an sectional view of the fastener container in the present invention.

The bottom of the second space 20 of the lid 2 is provided at least one tool holder(s) 23, such as V-shape holder (as shown in FIG. 11) or U-shape holder (as shown in FIG. 12), to utilize the tool holder(s) 23 to receive a variety of tools, and the tools can be concealed in the second space 20, so that the space of the second space 20 can be fully utilized.

When the user wants to lock the container, his/her only need to connect the combining circumference 12 of the receptacle base 1 with the groove 213 of the lid 2, and then licking the first locking member 15 and the second locking member 22, so that the container will be firmly lock. On the contrary, as long as the first locking member 15 and the second locking member 22 are separated from each other, the container can be quickly opened to facilitate the user to reach his/her hand into the first space 10 of the receptacle base 1 to take or put the screws or other items. In addition, the container can be hung on the wall or on the display stand by means of the pendant 13, and the pendant 13 can also be retracted if the container without hanging.

Therefore, this invention utilizes the integrally formed receptacle base 1 and lid 2, the user does not need to worry about that the lid missing during use, and the container can be made in any size and the structure of the container does not affect the use of the user. Moreover, the special structure of receptacle base 1 and lid 2 of this invention can effectively solve the problem that the screws or items fall from the opening on the side of the container to the outside when the locked container be extruded deformation by external force. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

receptacle base 1、first space 10、annular side wall 11、circumference 12、pendant 13、through hole 130、protrusion 14、first locking member 15、reinforcing ribs 16
lid 2、second space 20、circumferential wall 21、outer baffle 211、first inner baffle 212、groove 213、second inner baffle 214、second locking member 22、tool holder 23
hinge 3

What is claimed is:

1. A fastener container comprising a receptacle base and a lid, wherein:

the receptacle base has a first space, the receptacle base is provided with an annular side wall, two upwardly extending combining circumferences are separately set on the top of the annular side wall; a front of the receptacle base has a foldable pendant which is provided with a through hole, and a protrusion is set on outside of the front of the receptacle base for engagement with the through hole of the pendant; the top of said protrusion is provided with a first locking member;

the lid is connected with said receptacle base by a hinge, the lid has a second space, and a periphery of the lid is provided with a circumferential wall to correspond to the shape of said annular side wall of the receptacle base; an outwardly projecting outer baffle and a first inner baffle are individually provided under both sides of the circumferential wall, and a groove is formed between the outer baffle and the first inner baffle for containing the combining circumferences of the receptacle base; a height of the first inner baffle is greater than a height of the outer baffle;

a plurality of spaced second inner baffles is set on inside of the front of said circumferential wall which is corresponding to the shape of said annular side wall of the receptacle base; a front of the lid is provided with a second locking member to cooperate with the first locking member of the receptacle base to lock and fix the receptacle base and the lid together; and the bottom of the second space of the lid is provided with at least one tool holder to utilize the tool holder to receive a variety of tools, and the tools can be concealed in the second space.

2. The fastener container according to claim 1, wherein said receptacle base and said lid are made of plastic.

3. The fastener container according to claim 1, wherein said receptacle base and said lid are made of rubber.

4. The fastener container according to claim 1, wherein a plurality of reinforcing ribs are arranged at the bottom of the receptacle base.

5. The fastener container according to claim 1, wherein said tool holder is a V-shape holder.

6. The fastener container according to claim 1, wherein said tool holder is a U-shape holder.

* * * * *